US012735776B2

(12) United States Patent
Yang et al.

(10) Patent No.: US 12,735,776 B2
(45) Date of Patent: Sep. 15, 2026

(54) CARBON-DOPED ALLOY STEEL WITH SUPER ROOM-TEMPERATURE DUCTILITY AND ITS PREPARATION PROCESS

(71) Applicant: City University of Hong Kong, Hong Kong (HK)

(72) Inventors: Tao Yang, Hong Kong (HK); Qian Li, Hong Kong (HK)

(73) Assignee: City University of Hong Kong, Hong Kong (HK)

( * ) Notice: Subject to any disclaimer, the term of this patent is extended or adjusted under 35 U.S.C. 154(b) by 420 days.

(21) Appl. No.: 18/353,102

(22) Filed: Jul. 16, 2023

(65) Prior Publication Data

US 2025/0019809 A1 Jan. 16, 2025

(51) Int. Cl.

| | |
|---|---|
| ***C22C 38/08*** | (2006.01) |
| ***C21D 8/0221*** | (2026.01) |
| ***C21D 8/0247*** | (2026.01) |
| ***C22C 38/02*** | (2006.01) |
| ***C22C 38/04*** | (2006.01) |

(52) U.S. Cl.

CPC ..... *C22C 38/08* (2013.01); *C21D 8/0236* (2013.01); *C21D 8/0268* (2013.01); *C21D 8/0273* (2013.01); *C22C 38/02* (2013.01); *C22C 38/04* (2013.01); *C21D 2201/02* (2013.01); *C21D 2211/001* (2013.01)

(58) Field of Classification Search

None

See application file for complete search history.

(56) References Cited

PUBLICATIONS

Mao et al Effective grain size refinement of an Fe—24N—0.3C metastable austenitic steel by a modified two-step cold rolling and annealing process utilizing the deformation-induced martensitic transformation and its reverse transformation Journal of Materials Research and Technology 2022: 17:2690-2700 (Year: 2022).*

Jeongho Han et al., Superplasticity in a lean Fe—Mn—Al steel, Nature Communications, 2017, vol. 8, 751, p. 1-6.

T.G. Langdon, A unified approach to grain boundary sliding in creep and superplasticity, Acta Metall. Mater, 1994, vol. 42, No. 7, p. 2437-2443.

Atul H. Chokshi et al., Superplasticity in advanced materials, Materials Science and Engineering, 1993, Reports 10, p. 237-274.

(Continued)

*Primary Examiner* — Alexandra M Moore

(74) *Attorney, Agent, or Firm* — Idea Intellectual Limited; Sam T. Yip

(57) ABSTRACT

The present invention relates to a carbon-doped alloy steel with super room-temperature ductility, the carbon-doped alloy steel includes a chemical composition including 10-30 wt. % of nickel (Ni), 0.01-5 wt. % of silicon (Si), 0.01-2 wt. % of carbon (C), and 60-90 wt. % of iron (Fe). Different from traditional super-plastic alloys that could only obtain superplasticity at high homologous temperatures, the present invention introduces a super-ductile steel that exhibits a giant uniform elongation of over 100% at room temperature. Meanwhile, different from deformation softening in super-plastic alloys, super-ductile steels show an exceptional work-hardening capability, enabling them to obtain enough strength for application.

7 Claims, 18 Drawing Sheets

(56) References Cited

PUBLICATIONS

Kaveh Edalati et al., Room-Temperature Superplasticity in an Ultrafine-Grained Magnesium Alloy, Scientific Reports, 2017, vol. 7, 2662, p. 1-9.
H.W. Swift, Plastic instability under plane stress, Journal of the Mechanics and Physics of Solids, 1952, vol. 1, p. 1-18.
Erik Nes, Modelling of work hardening and stress saturation in FCC metals, Progress in Materials Science, 1998, vol. 41, p. 129-193.
Bernd Gludovatz et al., A fracture-resistant high-entropy alloy for cryogenic applications, Science, 2014, vol. 345, Issue 6201, p. 1153-1158.
Dierk Raabe et al., From High-Entropy Alloys to High-Entropy Steels, steel research int., 2015, vol. 86, No. 10, p. 1127-1138.
F.K. Yan et al., Strength and ductility of 316L austenitic stainless steel strengthened by nano-scale twin bundles, Acta Materialia, 2012, vol. 60, p. 1059-1071.
H.Y.Yi et al., Comparison of strength-ductility combinations between nanotwinned austenite and martensite-austenite stainless steels, Materials Science & Engineering A, 2015, vol. 647, p. 152-156.
Wolfgang Bleck et al., The TRIP Effect and Its Application in Cold Formable Sheet Steels, steel research int., 2017, vol. 87, No. 9999, 1700218.
Daniel Krizan, TRIP steels: advanced high strength multiphase steels for automotive applications, 14th International Scientific Conference CO-MAT-Tech, 2006, p. 659-668.
X.D. Wang et al., Novel ultrahigh-strength nanolath martensitic steel by quenching-partitioning-tempering process, J. Mater. Res., 2009, vol. 24, No. 1, p. 260-267.
J.T. Benzing et al., Effects of strain rate on mechanical properties and deformation behavior of an austenitic Fe—25Mn—3Al—3Si TWIP-TRIP steel, Materials Science & Engineering A, 2018, vol. 711, p. 78-92.
D. Raabe et al., Alloy Design, Combinatorial Synthesis, and Microstructure—Property Relations for Low-Density Fe—Mn—Al—C Austenitic Steels, JOM, 2014, vol. 66, No. 9, p. 1845-1856.
Bin Hu et al., Super-high-strength and formable medium Mn steel manufactured by warm rolling process, Acta Materialia, 2019, vol. 174, p. 131-141.
Daixiu Wei et al., Novel Co-rich high performance twinning-induced plasticity (TWIP) and transformation-induced plasticity (TRIP) high-entropy alloys, Scripta Materialia, 2019, vol. 165, p. 39-43.
Zhiming Li et al., Metastable high-entropy dual-phase alloys overcome the strength-ductility trade-off, Nature, 2016, vol. 534, p. 227-230.
B. Cantor et al., Microstructural development in equiatomic multicomponent alloys, Materials Science and Engineering A, 2004, vol. 375-377, p. 213-218.
G. Laplanche et al., Microstructure evolution and critical stress for twinning in the CrMnFeCoNi high-entropy alloy, Acta Materialia, 2016, vol. 118, p. 152-163.
S.-H. Joo et al., Tensile deformation behavior and deformation twinning of an equimolar CoCrFeMnNi high-entropy alloy, Materials Science & Engineering A, 2017, vol. 689, p. 122-133.
Zhiming Li et al., Strong and Ductile Non-equiatomic High-Entropy Alloys: Design, Processing, Microstructure, and Mechanical Properties, JOM, 2017, vol. 69, No. 11, p. 2099-2106.
Jeoung Han Kim et al., Mechanical properties and deformation twinning behavior of as-cast CoCrFeMnNi high-entropy alloy at low and high temperatures, Materials Science & Engineering A, 2018, vol. 712, p. 108-113.
Christian Haase et al., Influence of deformation and annealing twinning on the microstructure and texture evolution of face-centered cubic high-entropy alloys, Acta Materialia, 2018, vol. 150, p. 88-103.

* cited by examiner

CARBON-DOPED ALLOY STEEL WITH SUPER ROOM-TEMPERATURE DUCTILITY AND ITS PREPARATION PROCESS

FIELD OF THE INVENTION

The present invention generally relates to the field of material science. Specifically, it pertains to the development of a novel alloy steel with exceptional ductility at room temperature. The potential applications of super-ductile alloy steel include, but are not limited to, critical safety components such as front side members, floor side reinforcements, still inners, rear side members, B-pillar reinforcements, roof bows, A-frame reinforcements, etc.

BACKGROUND OF THE INVENTION

In order to fabricate complex parts with high precision in a single-cycle process, it is crucial to have materials with extremely large ductility, including superplasticity (defined as ultrahigh ductility above 300%)[1]. However, such ductility is typically achieved at elevated homologous temperatures and often exhibits limited uniform elongation and deformation softening.

Traditionally, achieving such high ductility involves triggering thermally-activated deformation mechanisms like grain-boundary sliding and coble creep at elevated temperatures relative to the melting point ($T/T_m$)[2,3]. The prepared alloys are not suitable for mass production due to their excessive energy consumption. Furthermore, the thermally-activated deformation mechanisms lead to deformation softening during super-plasticity and insufficient strength for structural applications[1,4]. Therefore, it is imperative to develop alloys with low-temperature (especially room-temperature) ultrahigh ductility and good strength, in order to reduce carbon footprints and energy consumption.

The uniform elongation of metallic materials at low homologous temperatures depends on their ability to undergo sufficient strain-hardening, which enables them to keep up with the increasing flow stress[5]. However, the strain-hardening capability decreases as strain increases, primarily due to the progressive accumulation of dislocations, thus setting the fundamental limit for the room-temperature ductility of metallic materials[6]. The main approach to enhance room-temperature ductility has been to reduce the stacking fault energy, promoting twinning-induced plasticity (TWIP) or transformation-induced plasticity (TRIP)[7]. Nevertheless, despite the inclusion of TWIP and TRIP, the room-temperature uniform elongation of metallic alloys has rarely exceeded 100%[8].

SUMMARY OF THE INVENTION

Accordingly, the objective of the present invention is to provide a carbon-doped alloy steel with super room-temperature ductility. In a first aspect, the carbon-doped alloy steel includes a chemical composition including 10-30 wt. % of nickel (Ni), 0.01-5 wt. % of silicon (Si), 0.01-2 wt. % of carbon (C), and 60-90 wt. % of iron (Fe). The incorporation of carbon into the FeNiSi alloy leads to a transformation in the phase composition, shifting from a single martensite phase to a single austenite phase.

In accordance with one embodiment, optionally the carbon-doped alloy steel further comprises 0.1-20 wt. % of manganese (Mn).

In accordance with one embodiment, the carbon-doped alloy steel has a uniform elongation of at least 100%.

In accordance with one embodiment, the carbon-doped alloy steel after cold rolling has a yield strength of at least 1200 MPa.

In accordance with one embodiment, the carbon-doped alloy steel is uniformly elongated during the whole tensile testing without obvious necking.

In accordance with one embodiment, the carbon-doped alloy steel shows a single face-centered cubic (fcc) structure with a fully recrystallized morphology.

In accordance with one embodiment, the carbon-doped alloy steel has an increased engineering strength of at least 30%.

In accordance with one embodiment, the carbon-doped alloy steel exhibits a true stress in a range of 1500-2200 MPa at a true strain ranging from 80-100%.

The present invention first observes super room-temperature ductility in the FeNiSiC alloy. This remarkable ductility is achieved through sustainable work-hardening capability. Specifically, carbon plays a crucial role in stabilizing the austenite phase, undergoes dynamic redistribution in the FeNiSiC alloy during deformation. This redistribution leads to local variations in stacking fault energy and austenite stability, triggering the sequential activation of multiple deformation mechanisms, i.e., dislocation slipping, deformation twinning, and martensite transformation in the single fcc-phase FeNiSiC alloy. These internal defects progressively refine the structure of the FeNiSiC alloy from tens of micrometers to the nanoscale, resulting in a sustainable work-hardening capability. These findings pave the way for enhancing the ductility of metallic materials by integrating various work-hardening mechanisms through the dynamic redistribution of critical solute elements.

In a second aspect, the present invention provides a method for preparing the carbon-doped alloy steel with super room-temperature ductility, including:

- arc melting one or more raw materials under a Ti-gettered argon atmosphere to obtain as-cast ingots;
- homogenizing the as-cast ingots;
- cold rolling the ingots at room temperature to achieve a thickness reduction of 40-60%;
- recrystallizing cold-rolled ingots to obtain a carbon-doped alloy steel;
- cold rolling the carbon-doped alloy steel with a thickness reduction of 50-80%; and
- performing an annealing treatment on the carbon-doped alloy steel to adjust the grain size.

In accordance with one embodiment, the homogenization reaction temperature is in a range of 1000-1150° C., and the reaction time is in a range of 1-2 hours.

In accordance with one embodiment, the recrystallization reaction temperature is in a range of 1000-1150° C., and the reaction time is in a range of 1-2 hours.

In accordance with one embodiment, the annealing reaction temperature is in a range of 800-1200° C., and the reaction time is in a range of 0.5-30 minutes.

The present invention has the following advantages:

(1) The super-ductile alloy steel exhibits a large room-temperature uniform elongation of over 100%. Compared with traditional super-plasticity, which could only be achieved at high homologous temperatures, such room-temperature super-ductility can effectively reduce energy costs during the forming process.

(2) Unlike deformation softening observed during super-plastic deformation, super-ductile alloy steels demonstrate an outstanding work-hardening capability, enabling them to achieve sufficient strength for applications after the forming process. As a result, this super-ductile alloy steel is an excellent candidate for near-net shape forming.

(3) The super-ductile alloy steel exhibits a superior strength-ductility synergy compared to many existing steels, such as Fe—Mn, 304, and 316L steels.

BRIEF DESCRIPTION OF THE DRAWINGS

Embodiments of the invention are described in more details hereinafter with reference to the drawings, in which.

DETAILED DESCRIPTION

Figure 1A:
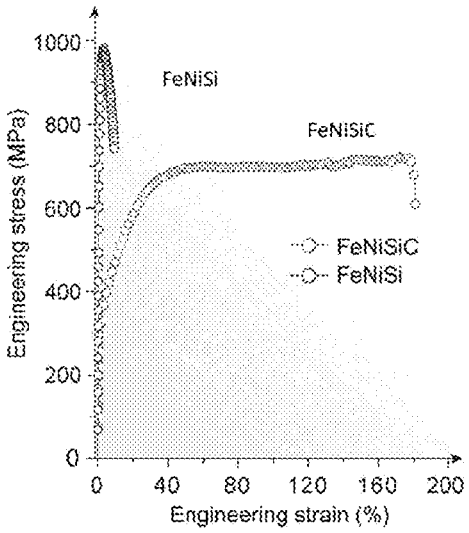
FIG. 1A depicts a comparison of engineering stress-strain curves of the FeNiSi and FeNiSiC.

Steel makes up around 65% of an average automobile's weight. In 2020, the high-strength steel consumption of the auto industry in China reaches 52.5 million tons. Due to the limited ductility of existing steels, the design of mechanical parts often needs to be as simple as possible, even at the expense of sacrificing their properties. Additionally, complex mechanical parts typically require separate fabrication and subsequent assembly, resulting in high energy costs.

In the steel, adding Ni, C, and Si could effectively stabilize the austenite and decrease the martensite transformation start temperature. However, excessive Mn, Ni, Si, and C make the austenite too stable and suppress the occurrence of deformation nanotwins and strain-induced martensite. Adding Si increases the strength of austenite and enhances the resistance to oxidation and corrosion. However, excessive Si facilitates the formation of the brittle phase, decreasing the ductility, toughness, and processability of the steel.

The present invention founds that carbon (C) plays an important role in controlling the deformation mechanisms by dynamically influencing stacking fault energy and austenite stability. The super-ductile carbon-doped steel makes it possible to fabricate parts with complex shapes in one step. In particular, the present invention provides a carbon-doped alloy steel with super room-temperature ductility, the carbon-doped alloy steel includes a chemical composition including 10-30 wt. % of nickel (Ni), 0.01-5 wt. % of silicon (Si), 0.01-2 wt. % of carbon (C), and 60-90 wt. % of iron (Fe). The carbon-doped alloy steel exhibits a room-temperature uniform elongation of at least 100% attributed to the incorporation of C into a FeNiSi alloy.

The basic principle for designing steels with super-ductile involves two aspects: (1) controlling the stability of the austenite phase to ensure that the steel consists primarily of austenite after quenching, and (2) adjusting the stacking fault energy and stability of the austenite to facilitate the sequential activation of various deformation mechanisms, in terms of dislocation, strain-induced twinning, and martensite transformation.

In one embodiment, the carbon-doped alloy steel includes four elements: 10-30 wt. % of nickel (Ni), 0.1-5 wt. % of silicon (Si), 0.01-2 wt. % of carbon (C), and 60-90 wt. % of iron (Fc). "wt %" in this context refers to weight percent, which is a measure of the relative weight of a particular element or component in the alloy steel compared to the total weight of the alloy steel itself.

Preferably, the carbon-doped alloy steel includes 23-25 wt. % of Ni, 0.8-3 wt. % of Si, 0.1-0.5 wt. % of C, and 71.5-76.1 wt. % of Fc.

In another embodiment, the carbon-doped alloy steel includes five elements: 10-30 wt. % of nickel (Ni), 0.1-20 wt. % of manganese (Mn), 0.01-5 wt. % of silicon (Si), 0.01-2 wt. % of carbon (C), and 43-89.88 wt. % of iron (Fc).

Preferably, the carbon-doped alloy steel includes 18-26 wt. % of Ni, 1-10 wt. % of Mn. 0.05-4 wt. % of Si, 0.05-0.9 wt. % of C and 59.1-80 wt. % of Fc.

In one embodiment, the carbon-doped alloy steel exhibits a uniform elongation of at least 100%. For instance, the carbon-doped alloy steel exhibits a uniform elongation of at least 110%, at least 120%, at least 130%, at least 140%, at least 150%, at least 160%, or at least 170%.

In one embodiment, the carbon-doped alloy steel after cold-rolling has a yield strength of at least 1200 MPa. For example, the yield strength is at least 1300 MPa, at least 1350 MPa, at least 1400 MPa after cold-rolling, which is three times higher than the yield strength before cold-rolling.

Preferably, after cold-rolling with a thickness reduction of 76%, the carbon-doped alloy steel could achieve a favorable combination of strength and ductility, specifically a yield strength up to 1400 MPa and a uniform elongation of 40%, surpassing that of most existing Fe—Mn steel, 304, and 316L stainless steels.

In one embodiment, the carbon-doped alloy steel has an increased engineering strength of at least 30%. For instance, the engineering strength increases at least 40%.

These exceptional forming capabilities and distinctive mechanical properties enable the super-ductile steels to be utilized in near-net shape-forming processes. In such processes, the super-ductile steels can be shaped into complex parts while simultaneously attaining sufficient strength for practical applications.

In another aspect, the present invention also provides a method for preparing the carbon-doped alloy steel with super room-temperature ductility. The processing of the super-ductile alloy includes four steps: (1) The alloy was fabricated by arc melting high-purity (99.9 wt. %) raw materials under a Ti-gettered argon atmosphere. (2) To eliminate the possible casting defects, the as-cast ingots were homogenized at 1000-1150° C. for 2 hours followed by cold rolling at room temperature to a thickness reduction of 40-60%, then recrystallized at 1000-1150° C. for 1-2 hours. This step could also be replaced by hot forging and hot rolling at the temperature above the austenitizing temperature. (3) Adjusting grain size by cold-rolling and subsequent recrystallization annealing treatment. The sample was cold rolled with a thickness reduction of 50-80%, followed by an annealing treatment at 800-1200° C. for 0.5-30 mins. The annealing treatment parameters should be chosen according to the thickness of cold-rolled samples.

Given the excellent combination of strength and ductility exhibited by the super-ductile alloy steel after forming, it has the potential to replace many existing advanced high-strength steels in applications such as automobiles, buildings, and shipbuilding. The super-ductile alloy steel is expected to attract considerable attention from automakers and steel enterprises.

EXAMPLE

Example 1

Preparation of Super-Ductility Alloys

The room-temperature super-ductility was realized by doping carbon in Fe—Ni—Si alloys with poor ductility. In one embodiment, the phase composition of super-ductile alloy steel includes 22-24 wt. % of Ni, 1-2.5 wt. % of Si, 0.3-0.5 wt. % of C and 73-76.7 wt. % of Fc. The materials were then homogenized at 1050-1100° C. for 2 h followed by cold rolling at room temperature with a thickness reduction of 60% and then recrystallized at 1050-1100° C. for 2 h. After being cold rolled at room temperature with a thickness reduction of 76% followed by annealing at 1100° C. for 1 min. The prepared super-ductile alloy steel (FeNiSiC alloy) can exhibit a super high uniform elongation of about 174%.

Example 2

Comparison Between FeNiSi Alloy and FeNiSiC Alloy

Figure 1B:
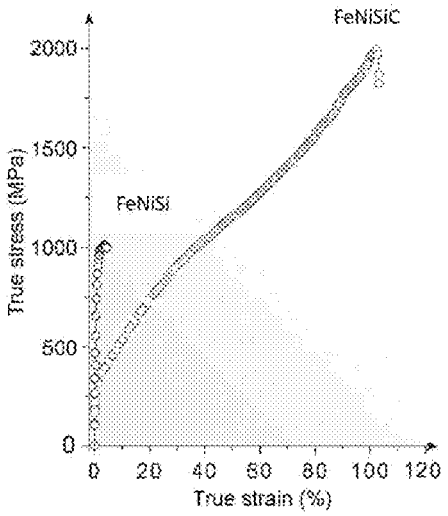
FIG. 1B depicts true stress-strain curves of the FeNiSi and FeNiSiC alloy.

In this example, FeNiSiC alloy was prepared and processed according to the description in the Example 1. FIG. 1A compared the engineering strain-stress curve of the Fe-24Ni-4Si (referred to as FeNiSi) and Fe-24Ni-4Si-2C (referred to as FeNiSiC), revealing that the two alloys exhibited significantly different mechanical properties. The FeNiSi alloy exhibited a limited uniform elongation of 3±0.1% and a total elongation of 10±1.1%. However, after C-doping, the FeNiSiC alloy became significantly softer and demonstrated super-ductility, with a uniform elongation of 174±4.1%, which was more than 50 times that of the FeNiSi alloy. Unlike high-homologous temperature superplasticity, which was characterized by work-softening, the FeNiSiC alloy exhibited a work-hardening behavior. The engineering strength of the FeNiSiC alloy increased from 294±15.6 MPa at the yield point to 735±14.4 MPa before fracture. Moreover, the FeNiSiC alloy exhibited a higher true stress compared to the FeNiSi alloy. The true stress of the FeNiSiC alloy reached up to 2,000 MPa at a true strain of 103%, which is double that of the FeNiSi alloy (1,000 MPa) (as shown in FIG. 1B).

Figure 1C:
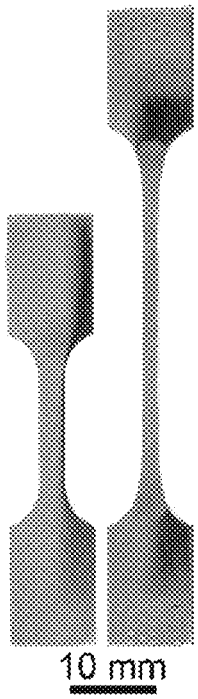
FIG. 1C shows an image of the tensile specimens of the FeNiSiC alloy before (left side) and after fracture (right side)
Figure 2:
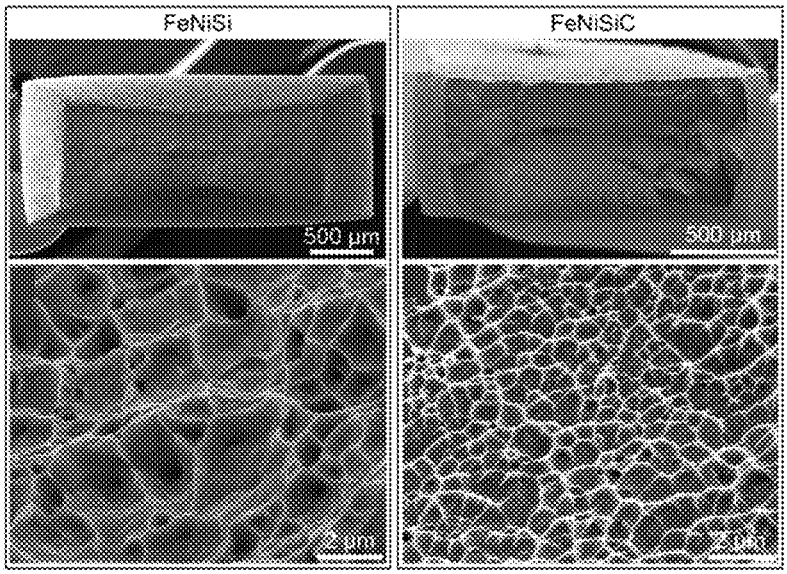
FIG. 2 depicts the tensile fractography of the FeNiSi and FeNiSiC alloys.

The appearance of the tensile samples (FIG. 1C) and fracture morphology (FIG. 2) demonstrates that the FeNiSiC was uniformly elongated during the whole tensile testing without obvious necking. Such room-temperature super-ductility accompanied by work-hardening behavior has not been reported in previous studies on steels or other super-plastic alloys.

Example 3

Characterization of Super-Ductility FeNiSiC Alloy

The significant difference in tensile properties between the FeNiSi and FeNiSiC alloys raises the question of the role of carbon in altering the initial microstructure, thereby transforming the brittle alloy into a quasi-superplastic alloy. To address this issue, a systematic investigation of the pre-deformed microstructures was conducted using techniques such as electron backscatter diffraction (EBSD), X-ray diffraction (XRD), atom probe tomography (APT), and transmission electron microscopy (TEM).

Figure 3A:
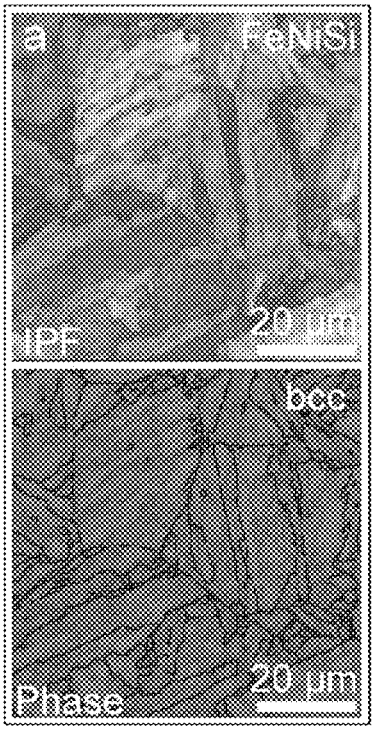
FIG. 3A shows the electron back-scattered diffraction (EBSD) inverse pole figure (IPF) color map and phase map showing the fully martensitic structure of the FeNiSi alloy.
Figure 3B:
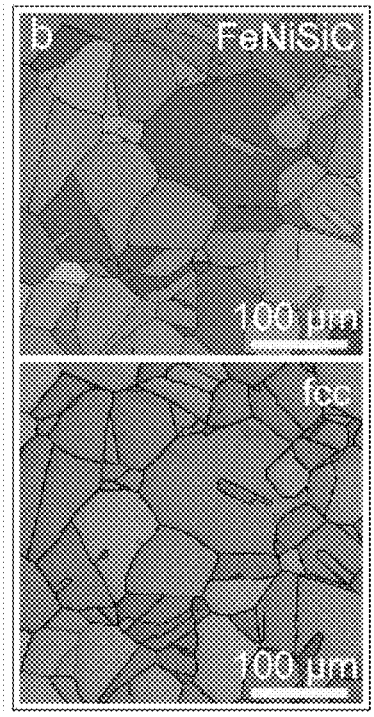
FIG. 3B shows the EBSD IPF color map and phase map showing the fully austenitic structure of the FeNiSiC alloy.
Figure 3C:
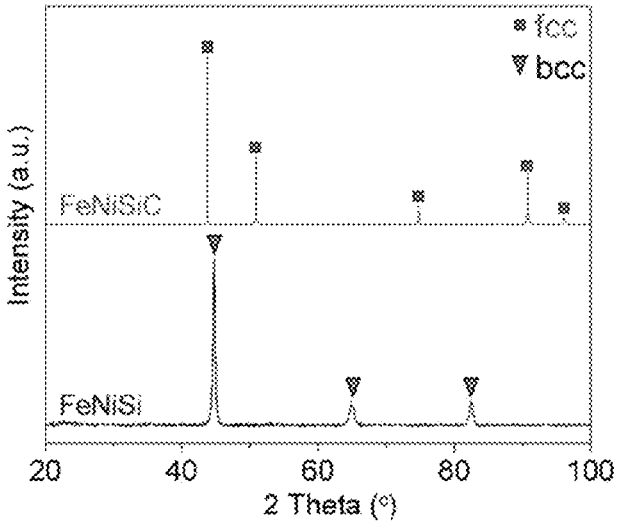
FIG. 3C depicts the X-ray diffraction (XRD) pattern of the FeNiSi alloy and FeNiSiC alloy.
Figure 3D:
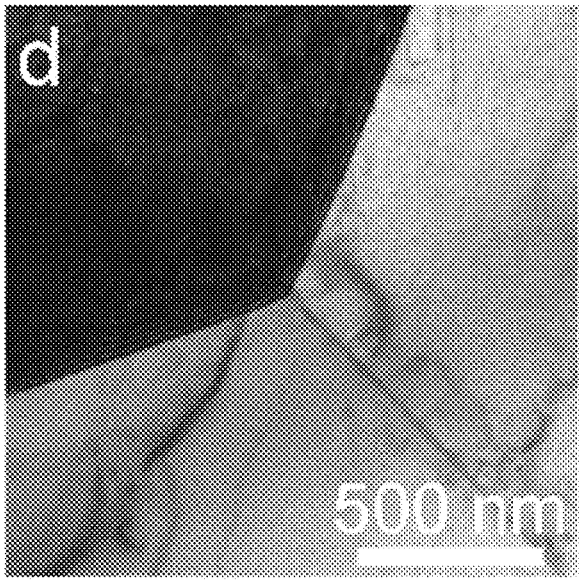
FIG. 3D shows a transmission electron microscopy (TEM) bright-field image of the FeNiSiC alloy.
Figure 3E:
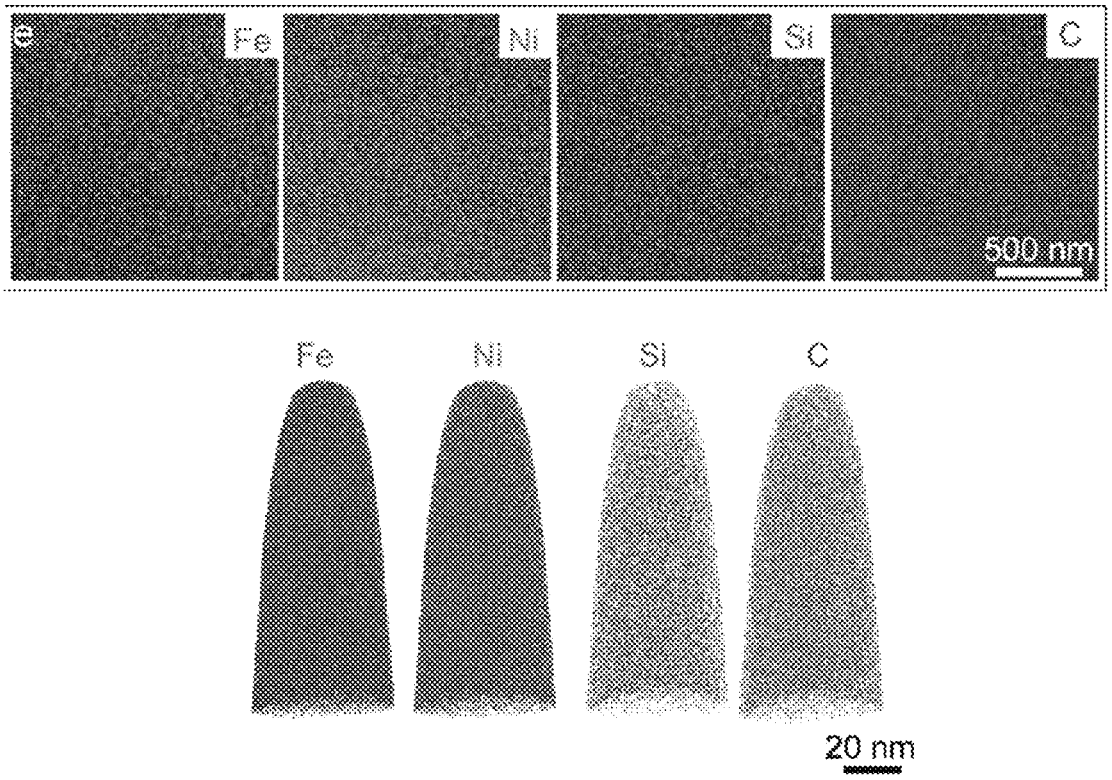
FIG. 3E shows EDS map of FeNiSiC alloy, and 3-dimensional atom probe tomography (3D-APT) reconstruction of the FeNiSiC tip showing the uniform distribution of each element.
Figure 3F:
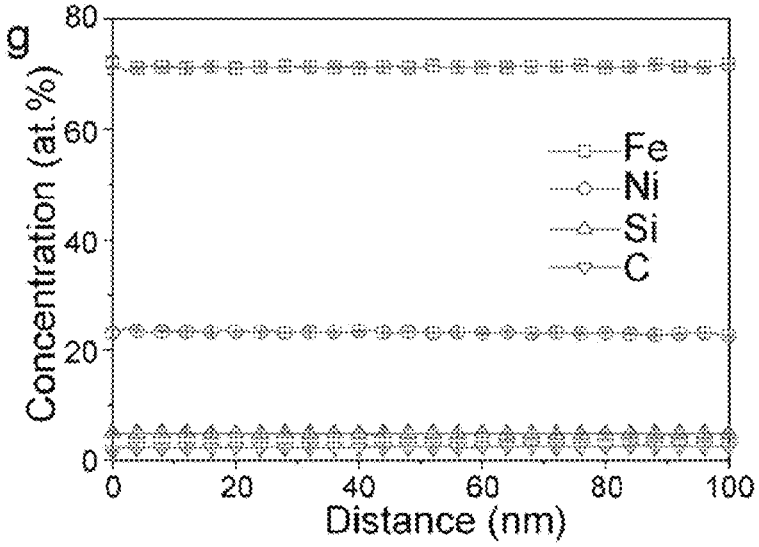
FIG. 3F depicts the corresponding one-dimensional (1-D) compositional profile that quantitatively reveals the elemental distribution through the tip.
Figure 4A:
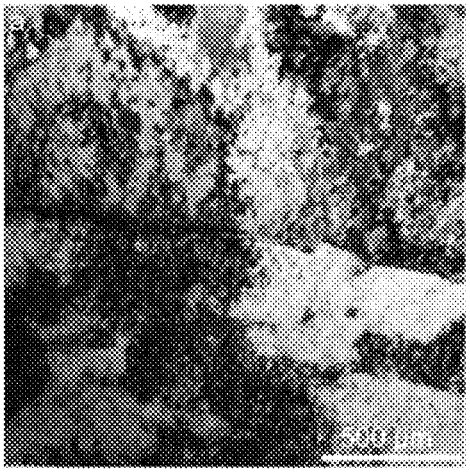
FIG. 4A shows a TEM image of microstructures of the FeNiSi alloys.

Inverse pole figure (IPF) map is a graphical tool commonly used in materials science and metallurgy to visualize the orientation of crystals and the spatial distribution of grain arrangements. Referring to FIG. 3, the microstructures of the FeNiSi and FeNiSiC alloys were shown. The FeNiSi alloy exhibited a single body-centered cubic (bcc) phase (FIGS. 3A and 3C), and had equiaxed grains with laminated substructures, as shown in the IPF map in FIG. 3A. Moreover, the TEM observation confirmed that the microstructure consisted of lath martensite, as depicted in FIG. 4A. The bright-field TEM image showed that the lath martensite with high-density dislocations. By contrast, the FeNiSiC alloy showed a single fcc structure with a fully recrystallized morphology (FIGS. 3B-3C). The addition of C into the FeNiSi alloy effectively transformed phase composition from a single martensite phase to a single austenite phase. The TEM bright-field image of the FeNiSiC alloy was shown in FIG. 3D.

Figure 4B:
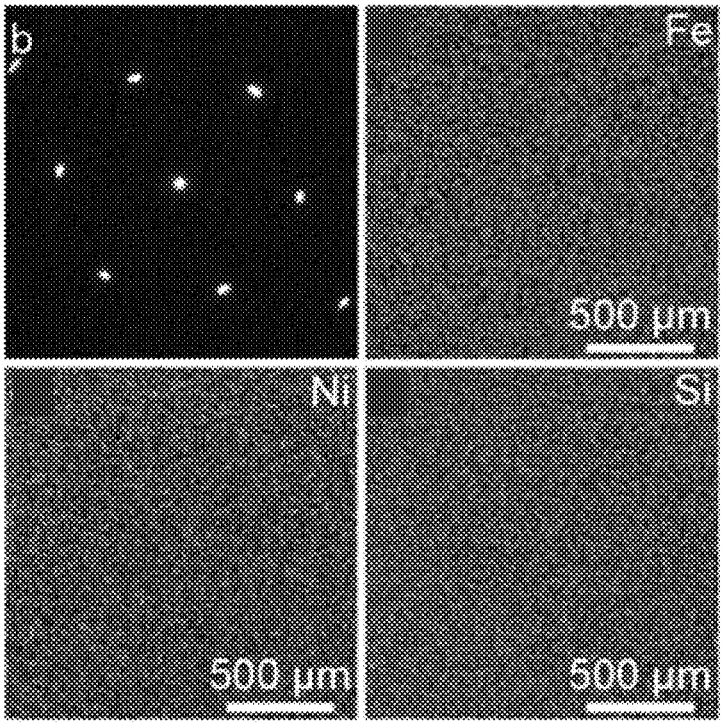
FIG. 4B shows the energy-dispersive-spectroscopy (EDS) map showing the uniform distribution of each element in the C-free alloy.

The elemental distribution of the two alloys was characterized by energy dispersive spectroscopy (EDS) on TEM. The results revealed that all the elements were uniformly distributed in both FeNiSiC alloys (FIG. 3E) and FeNiSi alloys (FIG. 4B).

Figure 5A:
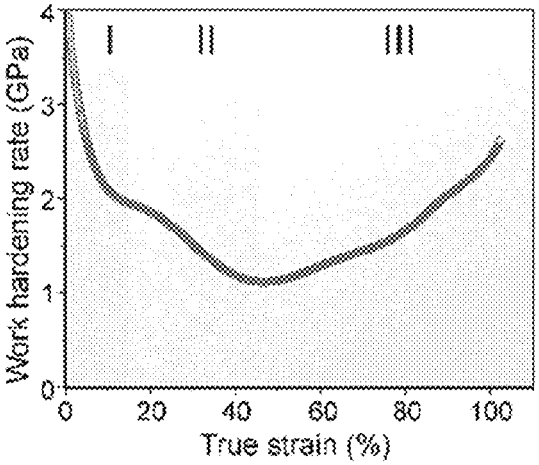
FIG. 5A depicts the strain-hardening curves of the FeNiSiC alloy presenting three strain-hardening stages.
Figure 5B:
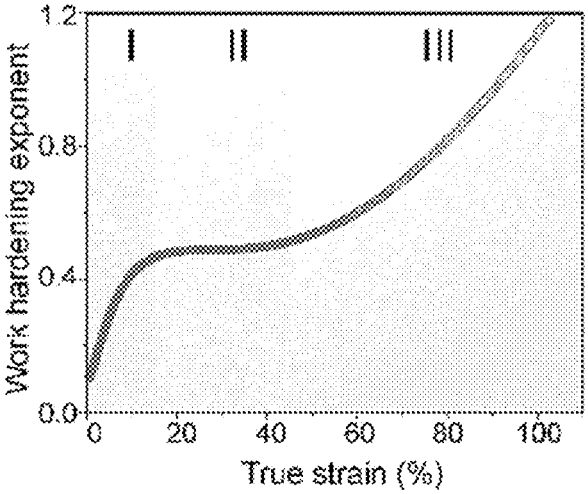
FIG. 5B depicts the dynamic change of the work-hardening exponent (i.e., the instantaneous work-hardening exponent) within the uniform deformation stage of the FeNiSiC alloy.
Figure 5C:
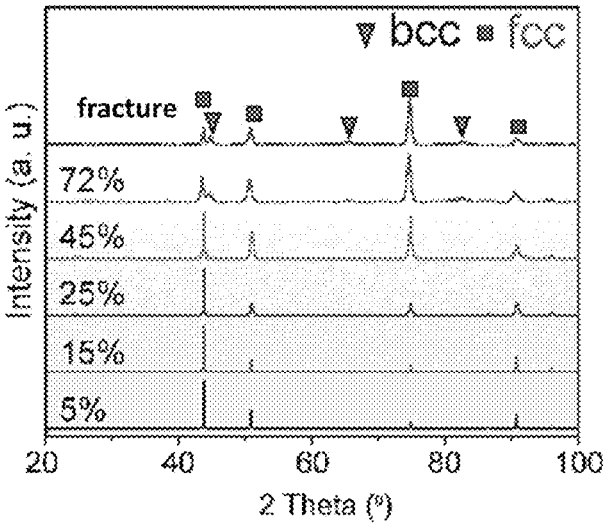
FIG. 5C depicts XRD patterns showing the phase composition of the FeNiSiC alloys at different true strains.

Considering the limited accuracy of TEM-EDS in characterizing light elements such as carbon, the chemical composition of the FeNiSiC alloy was further investigated using atom probe tomography (APT), which confirmed the chemical uniformity of the alloy without carbon segregation in the grain interior. Referring to FIG. 3F, the 1-D compositional profile of carbon along the tip axis shows no significant fluctuation in carbon concentration. Carbon, as a crucial austenite stabilizer, effectively enhances the stability of austenite and lowers the martensite transformation (Ms), thereby suppressing martensite transformation during thermal treatment. FIG. 5C showed the XRD patterns showing the phase composition of the FeNiSiC alloys at different true strains (5%, 15%, 25%, 45%, 72%, and fracture). Carbon doping transformed the phase composition from a brittle body-centered cubic (bcc) structure in the FeNiSi alloy to a ductile face-centered cubic (fcc) structure in the FeNiSiC alloy. This transformation is the primary reason for achieving super-ductility in the FeNiSiC alloy.

Different from the super-ductility at high temperatures that originates from a high strain rate sensitivity, the giant uniform elongation of FeNiSiC alloy stems from a sustainable work-hardening capability. Referring to FIG. 5A, after a rapid decrement in the work-hardening rate in the very beginning period (stage I, at the true strain, $\varepsilon_T$, below 15%), the decrement in the work-hardening rate was suppressed at $\varepsilon_r$ between 15% and 45% (stage II). Moreover, at the $\varepsilon_T \geq 45\%$ (stage III), the FeNiSiC alloy exhibited a continuously increased work-hardening capability until fracture ($\varepsilon_T$=102%). Correspondingly, the work hardening exponent increased with increasing true strains and reached an extremely high value of 1.2 at a true strain of 102%, demonstrating the exceptional work hardening capability of the FeNiSiC alloy (FIG. 5B).

Systematically microstructural characterizations reveal that the multiple work-hardening behaviors in the FeNiSiC alloy originate from the sequential activation of different deformation mechanisms, namely dislocation activation, deformation twinning, and $\gamma \rightarrow \alpha$ martensite. Similar to most polycrystalline fcc alloys, dislocations were the main carriers of plastic strains in stage I.

Figure 5D:
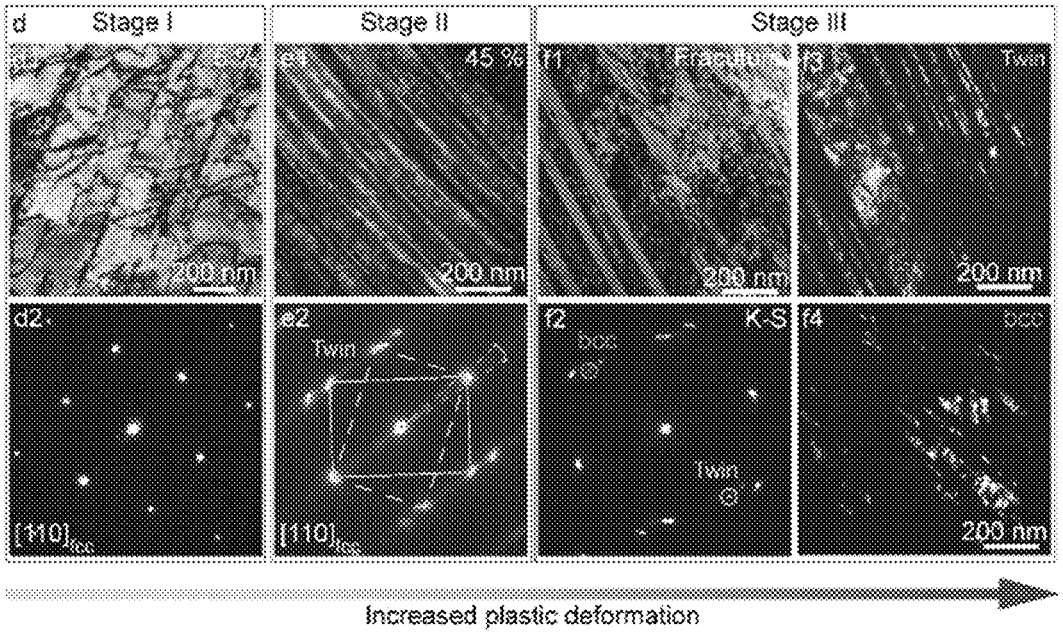
FIG. 5D shows the evolution of the microstructures of the FeNiSiC alloy with increasing strain.
Figure 6:
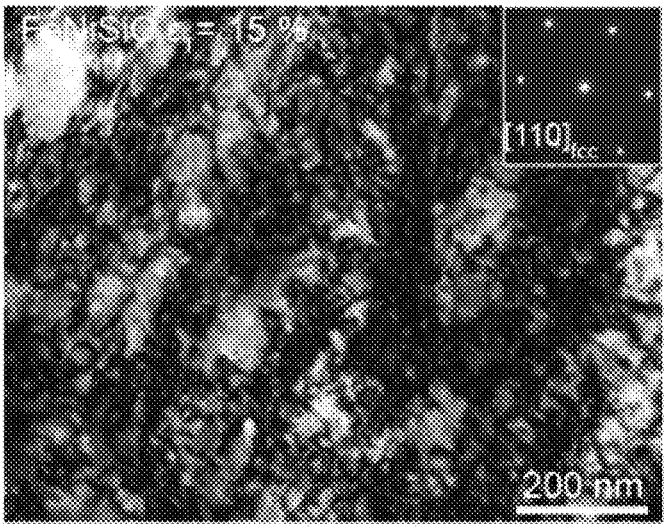
FIG. 6 shows the bright-field TEM image of the FeNiSiC alloy at the true strain of 15% showing dislocation tangles and cells.

FIG. 5D and FIG. 6 showed the typical dislocation networks at the $\varepsilon_T$ of 5% and the dislocation tangles at $\varepsilon_T$ of 15%, respectively. As the strain increased, the dislocation density also increased, leading to a decrease in the rate of dislocation accumulation. This decrease in the rate of dislocation accumulation was responsible for the decrease in the work-hardening rate.

Figure 7:
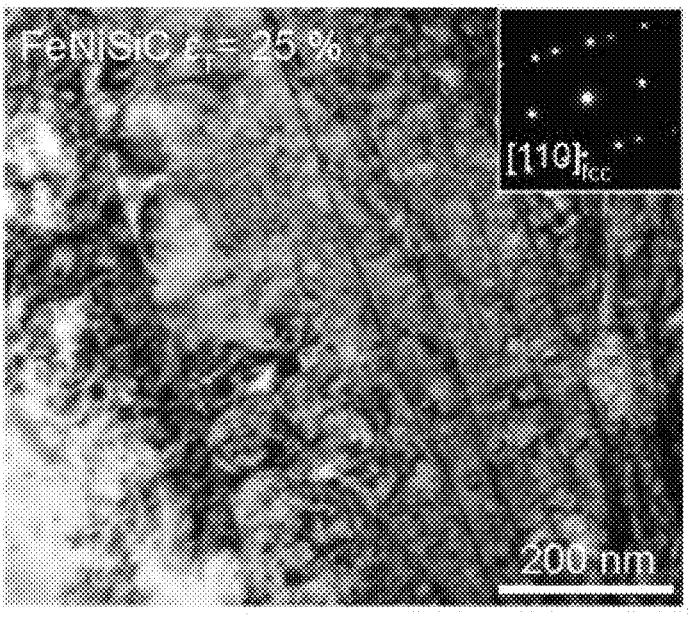
FIG. 7 shows the bright-field TEM image of the deformation twin in the FeNiSiC alloy at the true strain of 25%.
Figure 8A:
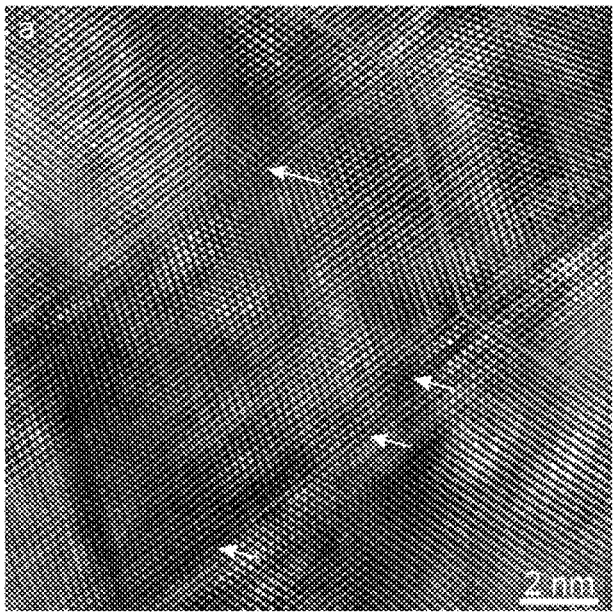
FIG. 8A shows the high-resolution TEM image of the deformation twin in the FeNiSiC alloy at the true strain of 45%.
Figure 8B:
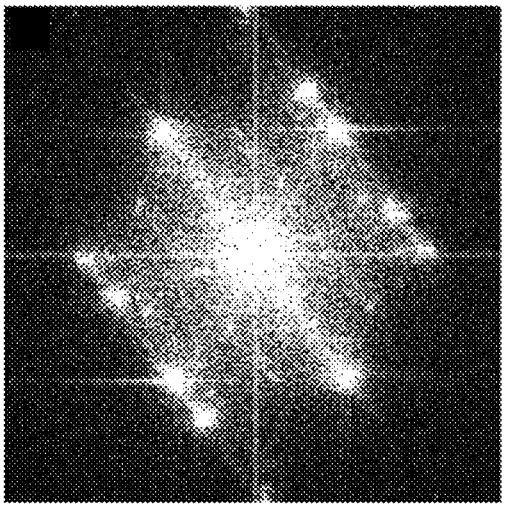
FIG. 8B shows the fast Fourier transformation (FFT) of the deformation twin in the FeNiSiC alloy at the true strain of 45%.
Figure 9A:
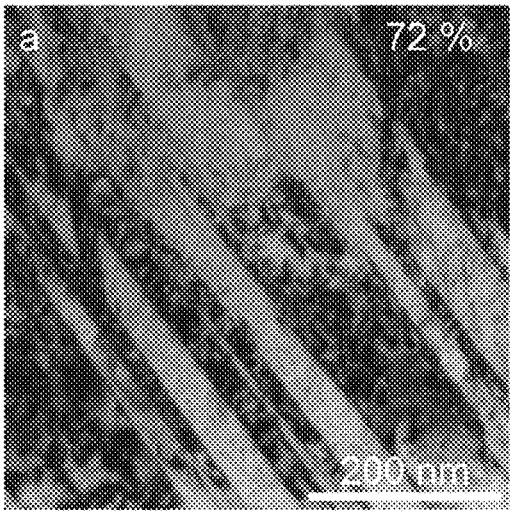
FIG. 9A shows the bright field TEM image of the martensitic nuclei in the FeNiSiC alloy at the true strain of 72%.
Figure 9B:
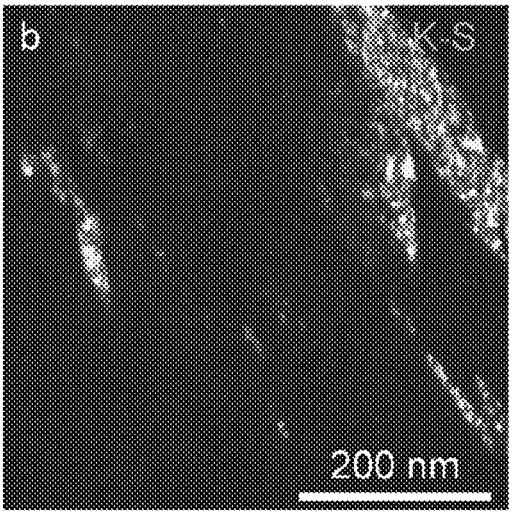
FIG. 9B shows the dark-field TEM image of the martensite phase in a Kurdjumov-Sachs orientation relationship (K—S, $(111)_\gamma//(1\bar{1}0)_\alpha$, $[\bar{1}10]_\gamma//[111]_\alpha$) in the FeNiSiC alloy at the true strain of 72%.

With further straining, deformation twins were activated in the FeNiSiC alloy during stage II. FIG. 7 showed the bright-field TEM image of the deformation twin in the FeNiSiC alloy at the true strain of 25%. FIG. 8A showed steps at deformation twin boundaries at the true strain of 45%, and FIG. 8B showed the corresponding fast Fourier transformation (FFT). FIG. 9A showed the high-resolution TEM image of the martensitic nuclei in the FeNiSiC alloy at the true strain of 72%, and FIG. 9B showed the corresponding FFT.

For example, at $\varepsilon_T$=45%, high-density nanoscale deformation twins (with an average twin/matrix lamellae of 26±6.4 nm) accompanied by stacking faults were observed, constituting a volume fraction of 30±5% (estimated by TEM). The rotation observed in the selected area electron diffraction pattern indicated that twin boundaries were distorted as a result of their strong interaction with dislocations. The presence of twin boundaries impeded further dislocation slip, thereby enhancing the work-hardening capability of the material. This allows the material to sustain more plasticity without undergoing necking.

Figure 9C:
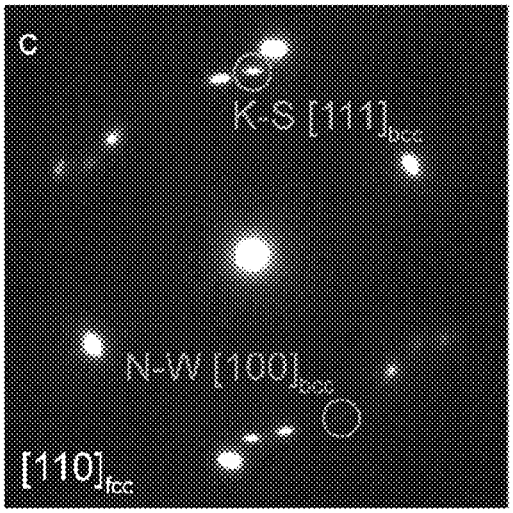
FIG. 9C shows the corresponding selected area diffraction pattern of FIG. 9A.
Figure 9D:
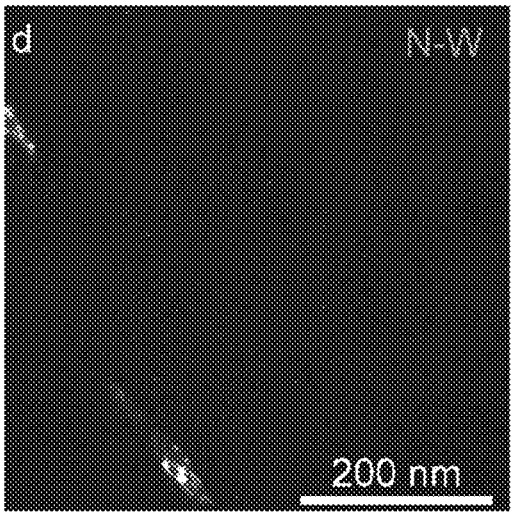
FIG. 9D shows dark-field TEM image of the martensite phase in a the Nishiyama-Wasserman orientation relationship (N—W, $(111)_\gamma//(1\bar{1}0)_\alpha$, $[\bar{1}01]_\gamma//[001]_\alpha$) in the FeNiSiC alloy at the true strain of 72%.

Subsequent to deformation twinning, α'-martensite transformation was also evoked to sustain plastic strains in stage III. The results showed that the α'-martensite tended to nucleate in the twinned region, either at the twin boundaries following the Kurdjumov-Sachs orientation relationship (K—S, $(111)_\gamma//(1\bar{1}0)_\alpha$, $[110]_\gamma//[\bar{1}11]_\alpha$, FIG. 9C) or within the twin/matrix lamellae following the Nishiyama-Wasserman orientation relationship (N—W, $(111)_\gamma//(1\bar{1}0)_\alpha$, $[\bar{1}01]_\gamma//[001]_\alpha$, FIG. 9D).

In addition, the volume fraction of martensite also increased with increasing strain, from 20 vol. % at a true strain of 72% to 34 vol. % at failure. Meanwhile, the volume fraction of deformation twins increased to 80 vol. % when failed. The extensive deformation twinning and the strain-induced α'-martensite transformation in stage III generated a nano-scale martensite-austenite dual-phase structure (FIGS. 10-11), leading to a continuous increase in the work-hardening rate in stage III.

The sequential activation of deformation twinning and α'-martensite transformation is abnormal in the single-phase fcc steel with a homogeneous recrystallized structure. Especially, the FeNiSiC alloy has a stacking fault energy of 22~27 mJ, which is supposed to be a TWIP alloy. Usually, a hierarchical structure is necessary to unify the two work-hardening mechanisms in metastable alloys, in which the grain-size hierarchy induces a wide variation in phase stability and thereby encourages the concurrent of different deformation mechanisms.

Chemical distribution plays a vital role in determining the stability of austenite. To investigate the microstructural origin of the multiple deformation mechanisms, the present invention characterized the evolution of chemical distribution in the FeNiSiC alloy during tensile tests using the correlative APT-TEM analysis.

Figure 12:
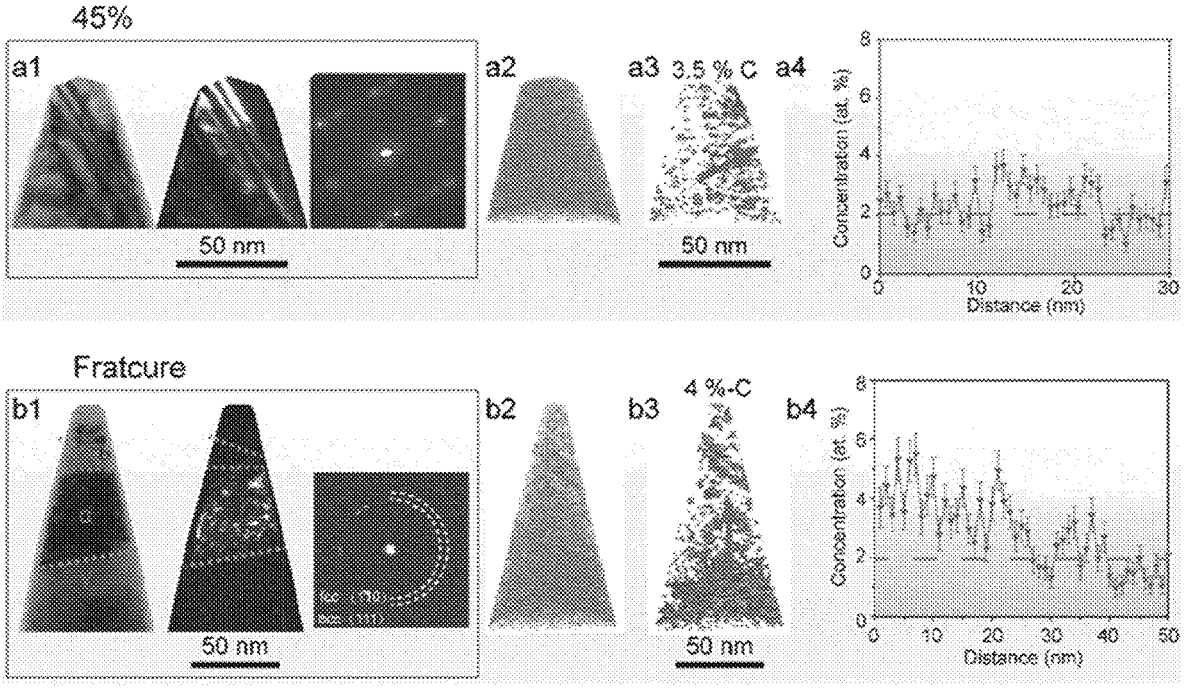
FIG. 12 shows dynamic carbon partition during tensile testing at room temperature.

FIG. 12 showed correlative APT and TEM characterization of C-distribution in the FeNiSiC alloy with the true strain of 45% (a) and post-fracture (b). Among them, (a1) and (b1) were bright-field image, dark-field image, and SAEDs of the APT-tips. (a2) and (b2) were the corresponding C atom map reconstructed using 3D-APT. (a3) and (b3) were the C isosurface with the concentration of 3.5 at. % and 4 at. %, respectively. (a4) and (b4) were 1-D compositional profile of C along the direction indicated by the arrows in (a3) and (b3), respectively.

Unexpectedly, the results showed that carbon, one of the important austenite stabilizers, tended to dynamically redistribute during the tensile testing at room temperature (FIG. 12). The tip at &T=45% containing nanotwins (a1) was analyzed by APT. The C atom maps (a2) and 3.5 at. % C iso-concentration surface (a3) revealed nano-scale carbon-rich clusters in the twinned region. The C-fluctuation was quantitatively revealed by the one-dimensional (1D) concentration profile (a4). The C-rich regions contained 3 at. % of carbon and are accompanied by C-depleted regions with the C-concentration as low as 1 at. %. The redistribution of carbon became more pronounced with the increase in strains. In the FeNiSiC alloy after fracture (b1-b4), the C content of retained austenite reached up to 5%, while the martensite showed a low carbon content of 1%.

Figure 13A:
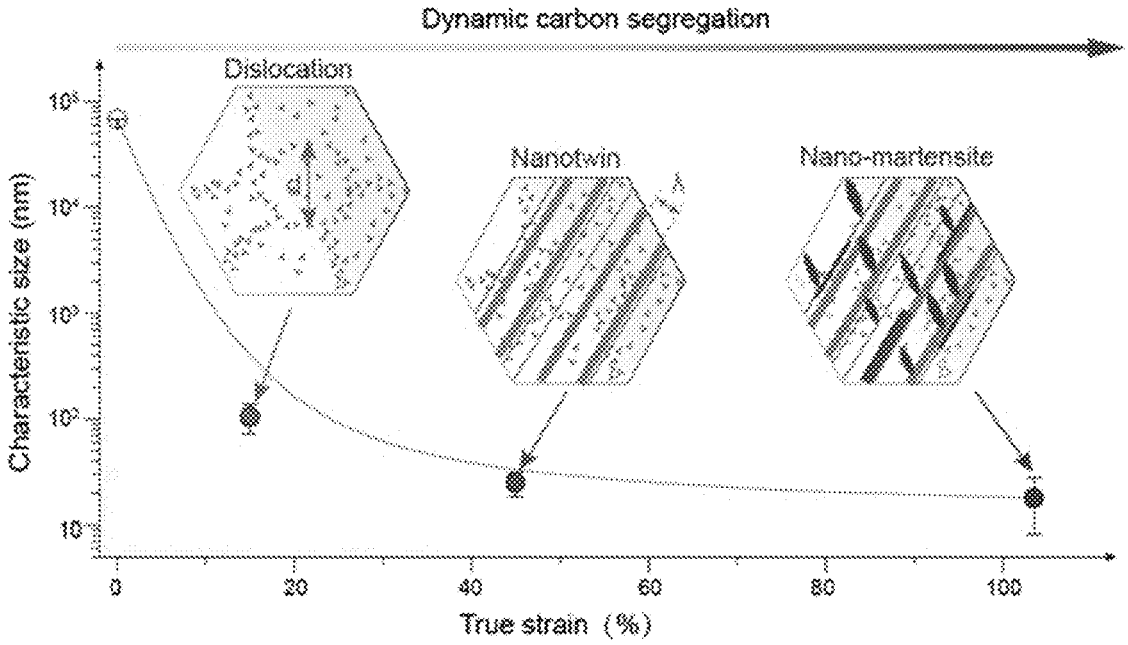
FIG. 13A depicts a schematic illustration of the variation of characteristic size with true strain. Multiple strain hardening mechanisms lead to in-situ refinement of the dislocation mean free path.

TWIP and α'-martensite transformation induced plasticity has been extensively studied in many alloys, which, however, could only push the room-temperature uniform elongation to a maximum of 103% and 50% (FIG. 13A). Although TWIP and a'-TRIP effect could be co-activated in some heterogeneous structured alloys, the total elongation could hardly exceed 100%. The total elongation of the present FeNiSiC alloy was utterly beyond various TWIP/TRIP Fe—Ni steel, Fe—Mn steel, and fcc-phase high entropy alloys (HEA). Specifically, the total elongation of FeNiSiC alloy was 1.8 times higher than that of Fe-20Mn-1.2C steel.

Figure 10A:
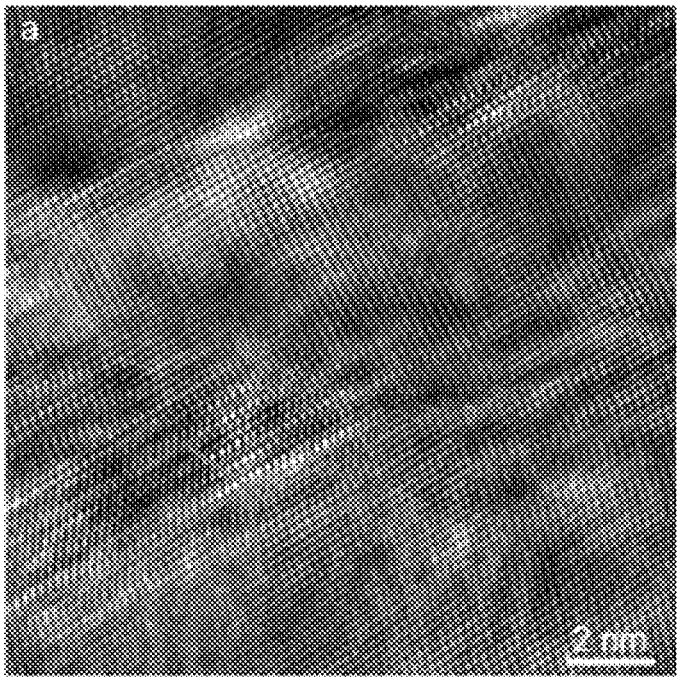
FIG. 10A shows the high-resolution TEM image of the martensitic nuclei in the FeNiSiC alloy at the true strain of 72%.
Figure 10B:
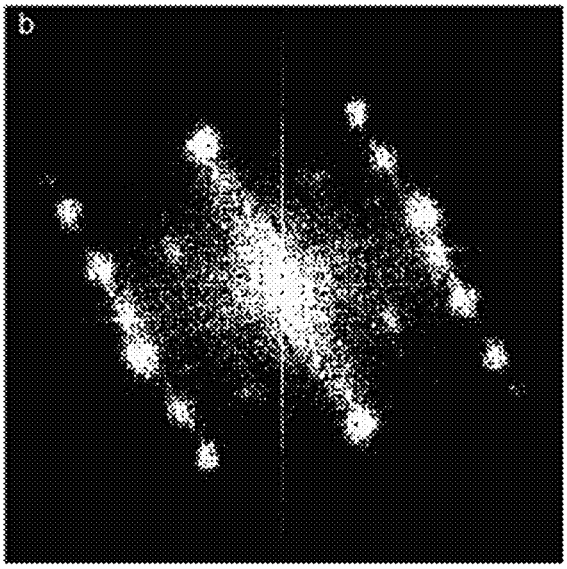
FIG. 10B shows the FFT of the martensitic nuclei in the FeNiSiC alloy at the true strain of 72%.
Figure 11A:
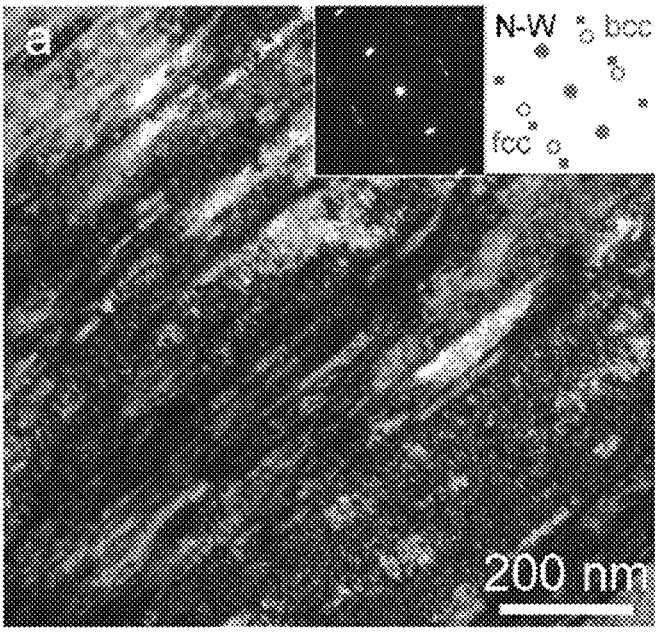
FIG. 11A shows the bright-field TEM image of the C-doped alloy after fracture. The insert showing the selected area diffraction pattern with the electron beam closely parallel to both the $[011]_{fcc}$ and $[001]_{bcc}$.
Figure 11B:
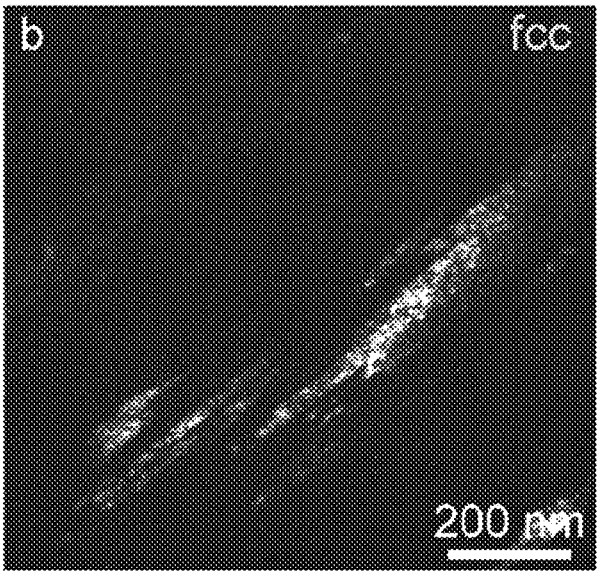
FIG. 11B shows the dark-field TEM image of the austenite (fcc) phase in FIG. 11A.
Figure 11C:
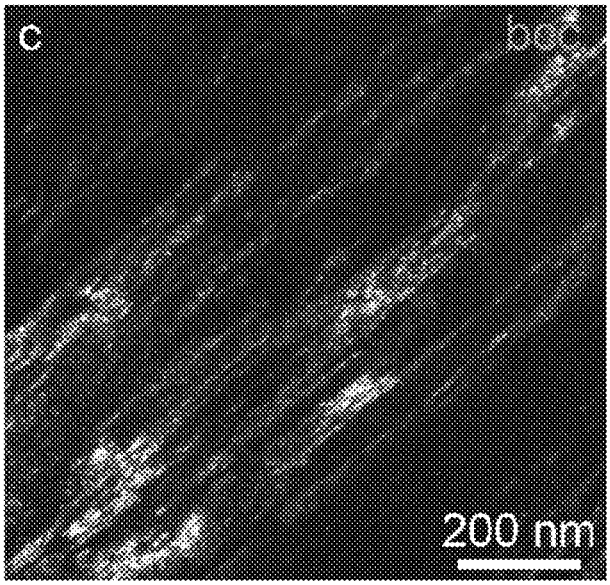
FIG. 11C shows the dark-field TEM image of the martensite (bcc) phase in FIG. 11A.
Figure 13B:
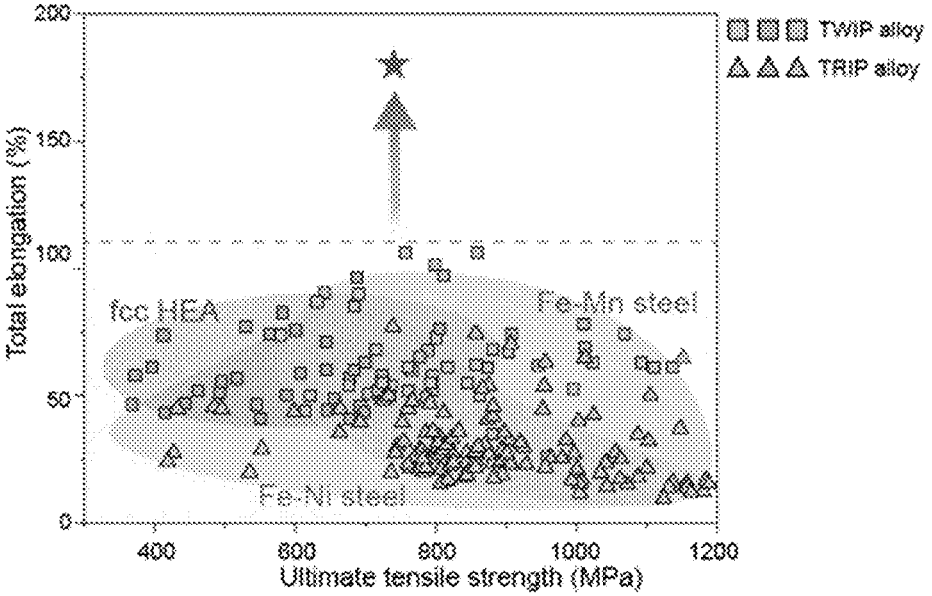
FIG. 13B depicts tensile properties of the present carbon-doped alloy steel and other existing high-ductility metallic materials at ambient temperature.

The pronounced TWIP and TRIP effects in the FeNiSiC alloy may be attributed to the following factors. Firstly, the density of deformation twins and martensite is super high, dividing the coarse grains into nanostructures, i.e., nanotwins with an average thickness of 25±6.4 nm and nanoscale martensite/austenite dual-phase structure with an average size of martensite of 13±0.9 nm (FIG. 13B and FIG. 10). On the other hand, the dynamic partition of carbon from newborn martensite to austenite increase the austenite stability and decreases the transformability of retained austenite. The critical stress for martensite transformation dynamically increases with the increase in strain, enabling martensite transformation to be carried out in progressive and controllable way. The martensite transformation rate is as low as 0.29 vol. % per engineering strain (%), one order of magnitudes than most TRIP steel, contributing to a sustainable work-hardening capability during an extremely large strain (approximately 117% engineering strain).

In summary, the present super-ductile steels emerge as excellent candidates for near-net shape-forming processes. For instance, when subjected to cold-rolling with a thickness reduction of about 76%, the super-ductile steel exhibits a yield strength of about 1400 MPa and a uniform elongation of about 40%. These values surpass those of most Fe—Mn, 304, and 316L steels currently available. Super-ductile steels facilitate the forming process and enhance the safety of mechanical parts, making them superior alternatives to Fe—Mn, 304, 316L steels, as well as certain superplastic alloys.

The foregoing description of the present invention has been provided for the purposes of illustration and description. It is not intended to be exhaustive or to limit the invention to the precise forms disclosed. Many modifications and variations will be apparent to the practitioner skilled in the art.

The embodiments were chosen and described in order to best explain the principles of the invention and its practical application, thereby enabling others skilled in the art to understand the invention for various embodiments and with various modifications that are suited to the particular use contemplated.

Definitions

It should be noted that the above-mentioned embodiments are only for illustrating the technical solutions of the present invention and not for limiting, and although the present invention has been described in detail with reference to the preferred embodiments, it should be understood by those skilled in the art that modifications or equivalent substitutions may be made on the technical solutions of the present invention without departing from the spirit and scope of the technical solutions of the present invention, which should be covered by the claims of the present invention.

As used herein, terms "approximately", "basically", "substantially", and "about" are used for describing and explaining a small variation. When being used in combination with an event or circumstance, the term may refer to a case in which the event or circumstance occurs precisely, and a case in which the event or circumstance occurs approximately. As used herein with respect to a given value or range, the term "about" generally means in the range of ±10%, ±5%, ±1%, or ±0.5% of the given value or range. The range may be indicated herein as from one endpoint to another endpoint or between two endpoints. Unless otherwise specified, all the ranges disclosed in the present disclosure include endpoints. The term "substantially coplanar" may refer to two surfaces within a few micrometers (μm) positioned along the same plane, for example, within 10 μm, within 5 μm, within 1 μm, or within 0.5 μm located along the same plane. When reference is made to "substantially" the same numerical value or characteristic, the term may refer to a value within ±10%, ±5%, ±1%, or ±0.5% of the average of the values.

Throughout this specification, unless the context requires otherwise, the word "comprise" or variations such as "comprises" or "comprising", will be understood to imply the inclusion of a stated integer or group of integers but not the exclusion of any other integer or group of integers. It is also noted that in this disclosure and particularly in the claims and/or paragraphs, terms such as "comprises", "comprised", "comprising" and the like can have the meaning attributed to it in U.S. Patent law; e.g., they allow for elements not explicitly recited, but exclude elements that are found in the prior art or that affect a basic or novel characteristic of the present invention.

Furthermore, throughout the specification and claims, unless the context requires otherwise, the word "include" or variations such as "includes" or "including", will be understood to imply the inclusion of a stated integer or group of integers but not the exclusion of any other integer or group of integers.

References in the specification to "one embodiment", "an embodiment", "an example embodiment", etc., indicate that the embodiment described can include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

In the methods of preparation described herein, the steps can be carried out in any order without departing from the principles of the invention, except when a temporal or operational sequence is explicitly recited. Recitation in a claim to the effect that first a step is performed, and then several other steps are subsequently performed, shall be taken to mean that the first step is performed before any of the other steps, but the other steps can be performed in any suitable sequence, unless a sequence is further recited within the other steps. For example, claim elements that recite "Step A, Step B, Step C, Step D, and Step E" shall be construed to mean step A is carried out first, step E is carried out last, and steps B, C, and D can be carried out in any sequence between steps A and E, and that the sequence still falls within the literal scope of the claimed process. A given step or sub-set of steps can also be repeated. Furthermore, specified steps can be carried out concurrently unless explicit claim language recites that they be carried out separately.

The term "super-ductile" or "superplasticity" refers to a material or alloy that exhibits an exceptionally high level of ductility or deformability under mechanical loading. It describes a material's ability to undergo large plastic deformation without fracture or failure, typically characterized by a significant uniform elongation and high total elongation before fracture.

The term "phase composition" refers to the relative proportions and types of different phases present in a material or alloy. In the context of the carbon-doped alloy steel, the phase composition refers to the distribution and amounts of different phases, such as martensite and austenite, within the alloy structure.

The term "austenite" is a specific crystal structure phase in iron and its alloys. It is characterized by a face-centered cubic lattice with close-packed atomic arrangement. Austenite exhibits good plasticity and ductility and is a common phase in certain steels. Austenite can be formed by cooling high-temperature iron alloys or during solid-state phase transformations, such as the transformation of austenite to the ferromagnetic phase called "martensite". Austenite plays an important role in many metal processes and material applications.

The term "Kurdjumov-Sachs orientation relationship" or "Nishiyama-Wasserman orientation relationship" refers to a specific crystallographic relationship between two phases in a material. It describes the orientation relationship between the parent phase (usually a high-temperature phase) and the transformed phase (usually a lower-temperature phase) during a phase transformation. In the case of Kurdjumov-Sachs orientation relationship, the crystal planes and directions of the parent and transformed phases are related by specific mathematical relationships, allowing for a coherent interface between the two phases.

Other definitions for selected terms used herein may be found within the detailed description of the present invention and apply throughout. Unless otherwise defined, all other technical terms used herein have the same meaning as commonly understood to one of ordinary skill in the art to which the present invention belongs.

It will be appreciated by those skilled in the art, in view of these teachings, that alternative embodiments may be implemented without undue experimentation or deviation from the spirit or scope of the invention, as set forth in the appended claims. This invention is to be limited only by the following claims, which include all such embodiments and modifications when viewed in conjunction with the above specification and accompanying drawings.

References: The Disclosures of the Following References are Incorporated by Reference

[1] J. Han, S.-H. Kang. S.-J. Lec, M. Kawasaki, H.-J. Lec, D. Ponge, D. Raabe, Y.-K. Lee, Superplasticity in a lean Fe—Mn—Al steel, Nat. Commun. 8(1) (2017) 751.

[2] T. G. Langdon, A unified approach to grain boundary sliding in creep and superplasticity, Acta Metall. Mater. 42 (7) (1994) 2437-2443.

[3] A. H. Chokshi, A. K. Mukherjee, T. G. Langdon, Superplasticity in advanced materials, Materials Science and Engineering: R: Reports 10 (6) (1993) 237-274.

[4] K. Edalati, T. Masuda, M. Arita, M. Furui, X. Sauvage, Z. Horita, R. Z. Valiev,
Room-Temperature Superplasticity in an Ultrafine-Grained Magnesium Alloy, Sci. Rep. 7 (1) (2017) 2662.

[5] H. W. Swift, Plastic instability under plane stress, Journal of the Mechanics and Physics of Solids 1 (1) (1952) 1-18.

[6] E. Nes, Modelling of work hardening and stress saturation in FCC metals, Prog. Mater. Sci. 41 (3) (1997) 129-193.

[7] B. Gludovatz, A. Hohenwarter, D. Catoor, E. H. Chang, E. P. George, R. O. Ritchie, A fracture-resistant high-entropy alloy for cryogenic applications, 345 (6201) (2014) 1153-1158.

[8] D. Raabe, C. C. Tasan, H. Springer, M. Bausch, From High-Entropy Alloys to High-Entropy Steels, 86 (10) (2015) 1127-1138.

What is claimed is:

1. A carbon-doped alloy steel with super room-temperature ductility, wherein the carbon-doped alloy steel is a FeNiSiC alloy comprising a chemical composition of:

10-30 wt. % of nickel (Ni);

1-2.5 wt. % of silicon (Si);

0.01-2 wt. % of carbon (C); and 60-90 wt. % of iron (Fe);

wherein the carbon-doped alloy steel exhibits a room-temperature uniform elongation of at least 100%; and wherein the room-temperature uniform elongation is capable of 174±4.1%.

2. The carbon-doped alloy steel of claim 1, wherein the incorporation of carbon into the FeNiSi alloy leads to a transformation in the phase composition, shifting from a single martensite phase to a single austenite phase.

3. The carbon-doped alloy steel of claim 1, wherein the carbon-doped alloy steel has a yield strength of at least 1200 MPa after being subjected to cold rolling with a thickness reduction of 50% to 80%.

4. The carbon-doped alloy steel of claim 1, wherein the carbon-doped alloy steel exhibits a continuous work-hardening behavior such that its strength increases with an increase of deformation during a plastic deformation stage until a fracture occurs.

5. The carbon-doped alloy steel of claim 1, wherein the carbon-doped alloy steel shows a single face-centered cubic (fcc) structure with a fully recrystallized morphology.

6. The carbon-doped alloy steel of claim 1, wherein the carbon-doped alloy steel has an increased engineering strength of at least 30%.

7. The carbon-doped alloy steel of claim 1, wherein the carbon-doped alloy steel exhibits a true stress in a range of 1500-2200 MPa at a true strain ranging from 80-100%.

* * * * *